US006104592A

United States Patent [19]

Pohl

[11] Patent Number: 6,104,592

[45] Date of Patent: Aug. 15, 2000

[54] ELECTROMECHANICAL SWITCHING DEVICE

[75] Inventor: Fritz Pohl, Hemhofen, Germany

[73] Assignee: Siemens Aktiengesellschaft, Munich, Germany

[21] Appl. No.: 09/383,869

[22] Filed: Aug. 26, 1999

Related U.S. Application Data

[63] Continuation of application No. PCT/DE98/00357, Feb. 9, 1998.

[30] Foreign Application Priority Data

Feb. 26, 1997 [DE] Germany ..... 197 07 724

[51] Int. Cl.[7] ..... H01H 47/00

[52] U.S. Cl. ..... 361/139; 361/160; 361/170; 324/207.15; 340/644

[58] Field of Search ..... 361/143, 139, 361/160, 170; 324/207.15, 207.16, 207.17, 207.18; 340/644

[56] References Cited

U.S. PATENT DOCUMENTS

| | | | |
|---|---|---|---|
| 4,503,395 | 3/1985 | Kratzer et al. . | |
| 4,706,073 | 11/1987 | Vila Masot . | |
| 4,967,156 | 10/1990 | Seitz . | |
| 5,115,197 | 5/1992 | Brandolino et al. . | |
| 5,264,733 | 11/1993 | Tigges | 307/116 |
| 5,617,023 | 4/1997 | Skalski | 324/207.17 |
| 5,754,387 | 5/1998 | Tennies et al. | 361/170 |
| 5,994,896 | 11/1999 | Andreas et al. | 324/207.17 |

FOREIGN PATENT DOCUMENTS

| | | |
|---|---|---|
| 0 483 369 A1 | 5/1992 | European Pat. Off. . |
| 0 685 866 A1 | 12/1995 | European Pat. Off. . |
| 32 26 266 C1 | 12/1983 | Germany . |
| 40 20 305 A1 | 1/1992 | Germany . |
| 44 30 382 A1 | 2/1996 | Germany . |
| 195 29 385 A1 | 2/1997 | Germany . |
| 197 07 729 A1 | 8/1997 | Germany . |
| 669 065 A5 | 2/1989 | Switzerland . |

OTHER PUBLICATIONS

Japanese Patent Abstract No. 61102712 (Hiroshi), dated May 21, 1986.

International patent Application WO 96/07192 (Pohl et al.), dated Mar. 7, 1996.

*Primary Examiner*—Michael J. Sherry

*Attorney, Agent, or Firm*—Herbert Lerner; Laurence A. Greenberg; Werner H. Stemer

[57] ABSTRACT

An electromechanical switching device includes at least one moveable contact and an associated drive in a device housing. Magnetic field sensors which are disposed at a suitable location inside and/or outside the device housing detect magnetic field values that are each linked to one of a plurality of switching states. The device housing has a switching handle which is intended for manual release. Through the use of a miniature inductance element with a ferrite core as a highly sensitive magnetic field sensor, a position of the switching handle or of a part coupled thereto is monitored and/or a current flowing in the switching device is detected.

11 Claims, 9 Drawing Sheets

ELECTROMECHANICAL SWITCHING DEVICE

CROSS-REFERENCE TO RELATED APPLICATION

This application is a continuation of copending International Application No. PCT/DE98/00357, filed Feb. 9, 1998, which designated the United States.

BACKGROUND OF THE INVENTION

Field of the Invention

The invention relates to an electromagnetic switching device including at least one moveable contact and an associated drive in a device housing, a device for contactlessly identifying a switching state has at least one magnetic field sensor, is disposed at a suitable location inside and/or outside the device housing and detects magnetic field values each linked to one of a plurality of switching states, and the device housing has a switching handle that is intended for manual release and has a position being monitored.

Switching states of electromechanical protective switchgear are characterized by release operations of a switch mechanism and, accordingly, can be identified by detecting a change in a position of certain components such as, for example, a switching handle of a usually present magnetometer or of an associated bimetal, and an associated occurrence of powerful magnetic fields in the event of overcurrent or short circuit.

German Published, Non-Prosecuted Patent Application DE 197 07 729 A1, provides magnetosensitive sensors such as Differential Hall Effect (DHE) sensors, Giant Magneto Resistive (GMR) sensors and Anisotropic Magneto Resistive (AMR) sensors for the purpose, in particular, of detecting movement of the switching handle of a circuit-breaker from a rotary movement of a drive clip that is coupled therewith.

The above-mentioned DHE, GME and AMR sensors in each case contain integrated electronics and supply normalized output signals. A GMR sensor, in particular, requires an additional differential amplifier. The GMR sensors, in particular, additionally have the peculiarity of deficient stability of sensor properties with respect to magnetic overdriving. Overall, the previously known sensors are comparatively complicated and expensive.

U.S. Pat. No. 4,706,073 discloses an alarm sensor system for an electromechanical switching device in which an iron-containing or non-iron-containing metallic pick-up element is present and constitutes a variable reluctance sensor. In that case, the intention is for the handle of the switching device to be monitored by such a sensor. In the event of release, the handle moves into the release position and transfers the proportion of the magnetic flux to the magnetic field sensor. The flux in the sensor changes and causes a current flow in the wire coil of the sensor. A voltage pulse is generated therefrom as pick-up signal.

SUMMARY OF THE INVENTION

It is accordingly an object of the invention to provide an electromechanical switching device, which overcomes the hereinafore-mentioned disadvantages of the heretofore-known devices of this general type and which has robust and inexpensive sensor elements for monitoring a position of parts carrying a magnetic field.

With the foregoing and other objects in view there is provided, in accordance with the invention, an electromechanical switching device, comprising a device housing having a switching handle intended for manual release and a part coupled to the switching handle, the handle and the part having a position to be monitored; at least one moveable contact and a drive associated with the at least one moveable contact in the device housing; a device for contactlessly identifying a switching state, the device including at least one magnetic field sensor disposed at a suitable location inside and/or outside the device housing and detecting magnetic field values each linked to one of a plurality of switching states; the magnetic field sensor being a highly sensitive miniature inductance element having a ferrite core and forming an inductance sensor for monitoring the position of the switching handle or the part and/or detecting a current flowing in the switching device; and the ferrite core of the miniature inductance element having a permeability altered by an action of external magnetic fields.

In accordance with another feature of the invention, there is a distinct sensitivity with respect to field direction, in particular in the case where the miniature inductance element has pronounced axial geometry.

The miniature inductance elements used according to the invention are known per se from the prior art, for example from German Published, Non-Prosecuted Patent Application DE 40 20 305 A1. It is surprising that such known miniature inductance elements are suitable for the application of state identification in switching devices. The variable inductance of the miniature inductance element can preferably be evaluated by an oscillator circuit.

Since known miniature inductance elements are mass-produced in a wide variety of embodiments, they are a mature product and, advantageously, are extremely inexpensive. The ferrite core of the miniature inductance element serves as the actual sensor device for the intended use in the case of the invention. The core changes the permeability as a result of the action of external magnetic fields.

In accordance with another feature of the invention, there is provided an evaluation circuit evaluating an inductance of the miniature inductance element with an oscillator circuit.

In accordance with a further feature of the invention, the part coupled to the switching handle is a ferromagnetic drive clip for the switching handle, and the inductance sensor together with an associated permanent magnet and an additional iron plate for field strengthening are disposed next to the ferromagnetic drive clip for detecting an on/off state of the switching handle.

In accordance with an added feature of the invention, there is provided a square-wave generator for feeding the evaluation circuit, and a differential amplifier for further processing an output signal.

In accordance with an additional feature of the invention, there is provided another inductance sensor, the two inductance sensors forming a differential circuit.

In accordance with yet another feature of the invention, there is provided a solenoid acting as a release coil, the miniature inductance element having a magnetic field sensitivity utilized for measuring current in the release coil.

In accordance with a concomitant feature of the invention, there is provided a permanent magnet acting as a pick-up element connected to the part to be monitored, the miniature inductance elements used as proximity and/or angle sensors.

Other features which are considered as characteristic for the invention are set forth in the appended claims.

Although the invention is illustrated and described herein as embodied in an electromechanical switching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
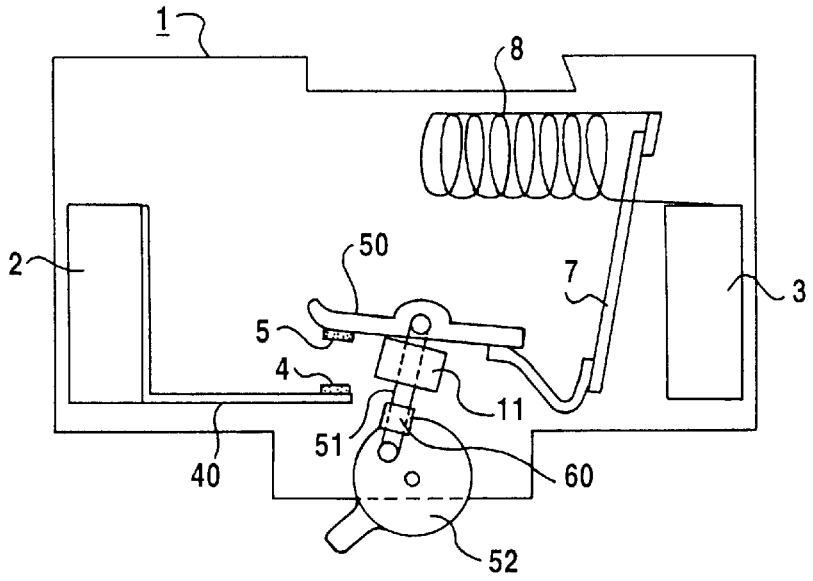
FIG. 1 is a diagrammatic, elevational view of a switching device with an inductance sensor and an associated permanence magnet, which are both fitted outside a switch housing.

Referring now to the figures of the drawings in detail and first, particularly, to FIG. 1 thereof, there is seen a spatial configuration, chosen on an experimental set-up, of a sensor system for a circuit-breaker. The sensor system is situated outside a switch housing 1 at a small distance from a side wall of the housing and is illustrated in such a manner as to be projected onto a switching device. The switch housing 1 is provided in a known manner with connecting terminals 2 and 3, a contact configuration including a fixed contact 4 and a moving contact 5, associated connections with a bimetal in the form of a line connection 7 as well as a solenoid 8, represented in a simplified illustration. The fixed contact 4 is situated on a rigid contact carrier 40 and the moving contact 5 is situated on a moveable contact carrier 50, which can be activated through the use of a drive clip 51 made of ferromagnetic material and a rotary handle 52. Elements 51 and 52 may be described as a switching handle part 52 and another part 51 coupled to the switching handle part 52.

Figure 2:
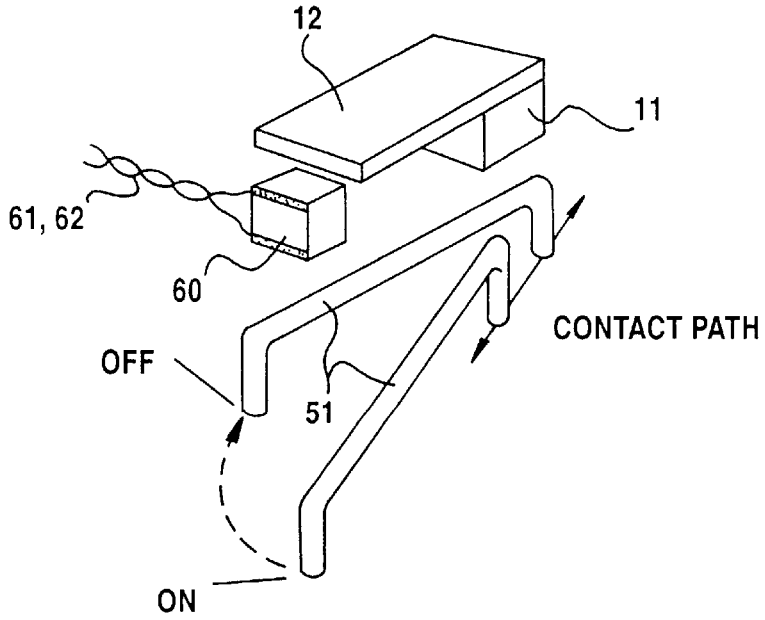
FIG. 2 is an exploded, perspective view of a sensor configuration and drive clip of FIG. 1 for explaining a positional identification.

It is seen in a projected illustration, that a permanent magnet 11 is fitted "under" the moveable contact carrier 50, and an inductance sensor 60 with electrical connections 61, 62 is assigned to the permanent magnet, according to FIG. 2. The permanent magnet 11 is provided with a field-strengthening iron plate 12.

In order to identify the position of the ferromagnetic drive clip 51 with the inductance sensor 60, the magnetic field of the permanent magnet 11 is coupled onto the drive clip 51. The iron plate 12 is applied on that side of the permanent magnet which is remote from the drive clip 51, for the purpose of field strengthening. The iron plate 12 projects above the inductance sensor 60 approximately as far as the center of the latter.

In accordance with FIG. 2, the inductance sensor 60 is situated between approximately parallel limbs of a U-shaped magnetic circuit including the drive clip 51 and the iron plate 12. A transverse limb of the U-shaped magnetic circuit is formed by the permanent magnet 11. In this case, the magnetization direction is chosen in such a way that the magnetic field emerges from the permanent magnet 11 perpendicularly to the plane of the drawing in FIG. 1.

Figure 3:
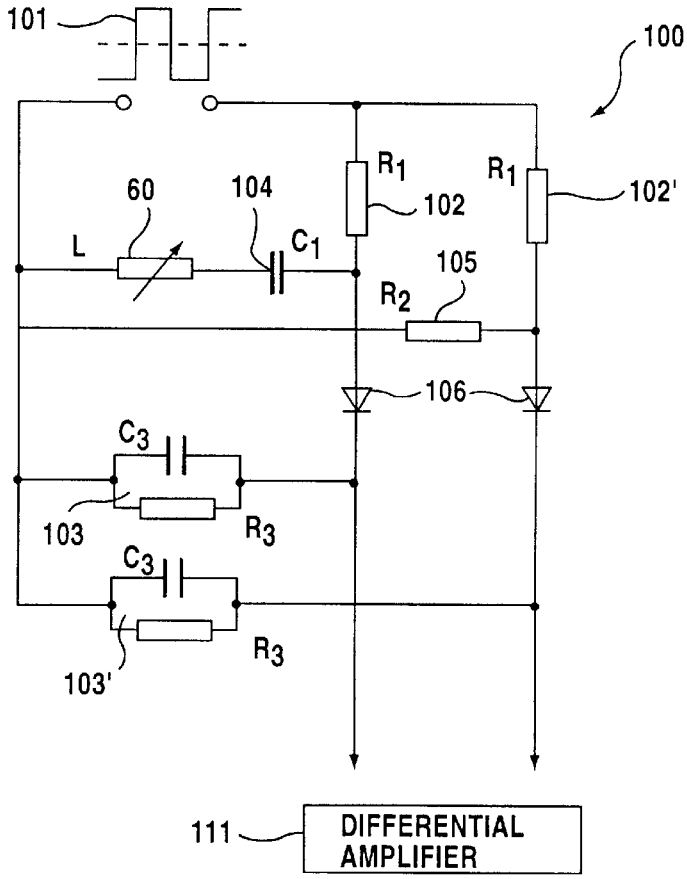
FIG. 3 is a schematic and block diagram of an evaluation circuit for measuring an inductance change in an inductance sensor used in FIG. 1.

In an evaluation circuit 100 according to FIG. 3, a signal circuit is fed by a square-wave generator 101 with, for example, an amplitude of ±15 V, a frequency ~1 MHz and a current consumption ~1 mA. An output signal is processed further through the use of a differential amplifier 111.

As a result of a change in the magnetic flux in the inductance sensor 60 when the ferromagnetic drive clip 51 rotates from a switch-off to a switch-on position, the inductance changes, for example from 450 $\mu$H ($=L_{off}$) to 470 $\mu$H ($=L_{on}$). In order to be able to measure this comparatively small relative induction change of 4%, the measuring circuit contains a compensation path for defining a zero differential voltage, in addition to the actual measuring path. The two measuring paths are constructed identically to the greatest possible extent, in order to avoid a temperature drift of an output voltage, which is dependent on diode properties. In detail, the measuring paths in each case contain a resistor 102, 102' where $R_1$=10 kω and RC elements 103, 103' where $C_3$=100 nF and $R_3$=10 kω. Reference symbol L designates a variable inductance of the inductance sensor 60. A capacitor 104 where $C_1$~6.8 nF is connected downstream of the inductance element 60 to form one evaluation path, and a resistor 105 where $R_2$=4.7 kω is connected downstream to form the other evaluation path. Rectification takes place in the signal paths through the use of diodes 106. The RC elements serve for signal integration.

Figure 4:
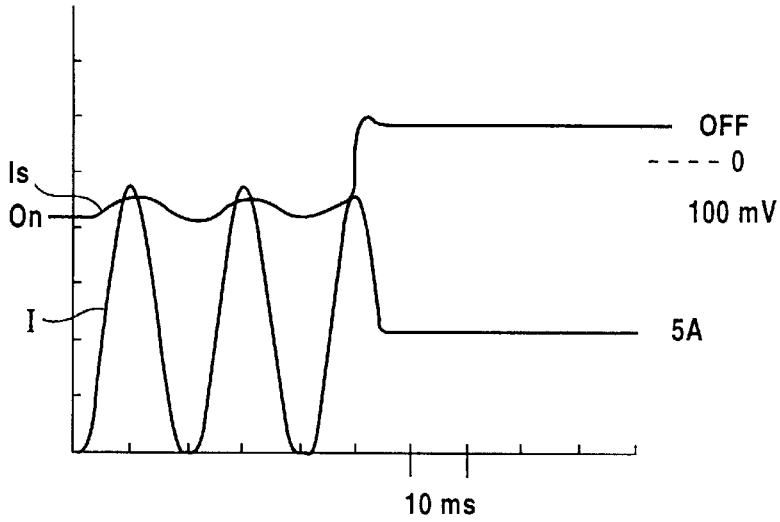
FIG. 4 is a graph of an oscillogram for a manual switch-off of a circuit-breaker.

FIG. 4 shows an associated measurement oscillogram with a time characteristic of a sensor signal Is and influencing thereof by the magnetic field of the electric current flowing in the switch. In order to avoid field distortion due to iron parts, for example of neighboring circuit-breakers, an iron shield, for example with a 0.8 mm iron plate, should be provided on the outside of the sensor set-up at the location of the inductance sensor 60. It is evident from the oscillogram that the magnetic field is superposed on the field of the permanent magnet and modulates the position signal of the inductance sensor 60.

Figure 5:
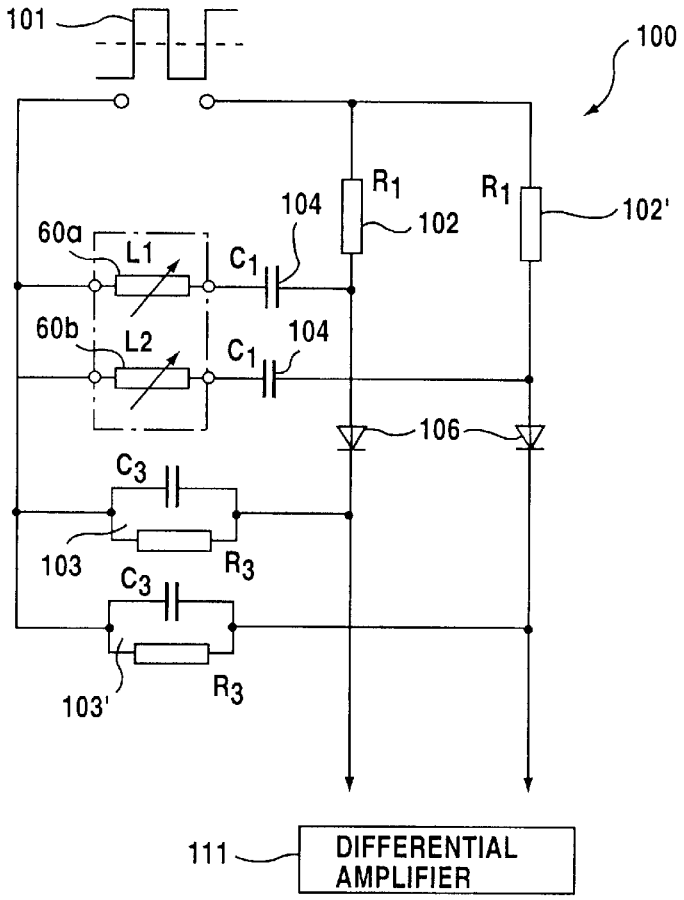
FIG. 5 is a schematic and block diagram of a balanced evaluation circuit for measuring an inductance change in a differential inductance sensor.

FIG. 5 shows an evaluation circuit 100 according to FIG. 3 which is modified in such a way that a differential connection of two inductance sensors 60*a* and 60*b* with inductances L1 and L2 is effected. Each of the sensors 60*a* and 60*b* is connected through a capacitor 104 where C1~6.8 nF to one of the evaluation paths. The configuration otherwise corresponds to the configuration described with regard to FIG. 1. Such a differential inductance sensor supplies a considerably smaller interference signal of the electric current flowing in the switch.

Figure 6:
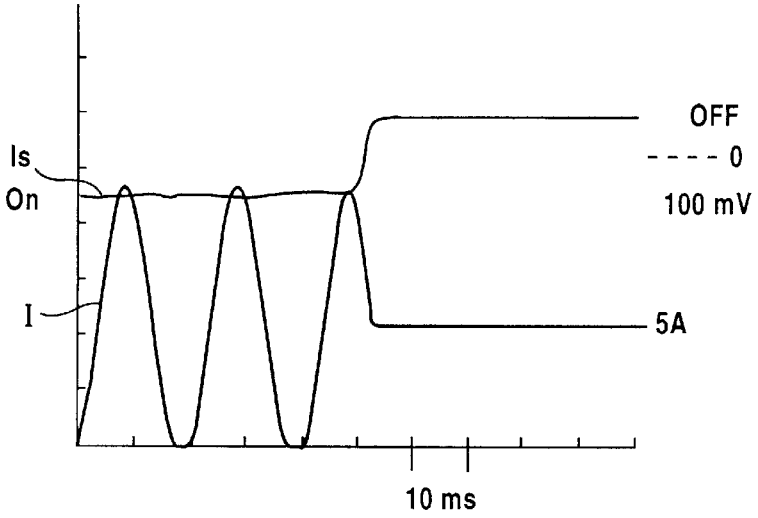
FIG. 6 is a graph of an oscillogram of a manual switch-off of a circuit-breaker with a differential inductance sensor.

An oscillogram in FIG. 6 specifically reveals that the signal modulation by the magnetic field in the case of the differential inductance sensor is considerably less when compared with FIG. 4. Ideally, as a result, in the course of the differential evaluation, the position signal remains unattenuated, while the interference signal, which has approximately the same magnitude at both sensors, is suppressed.

Figure 7:
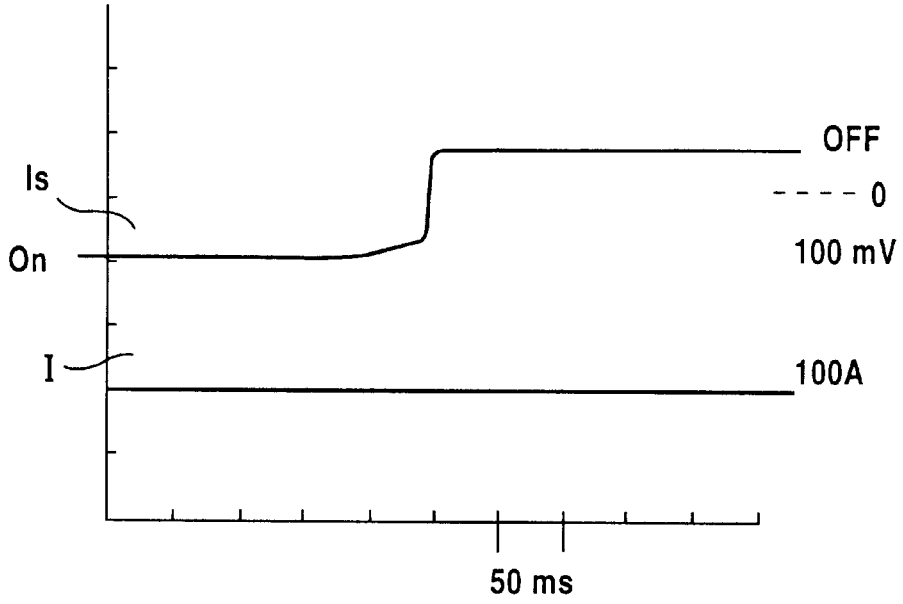
FIGS. 7 to 9 are graphs of various oscillograms for explaining the switching behavior.
Figure 8:
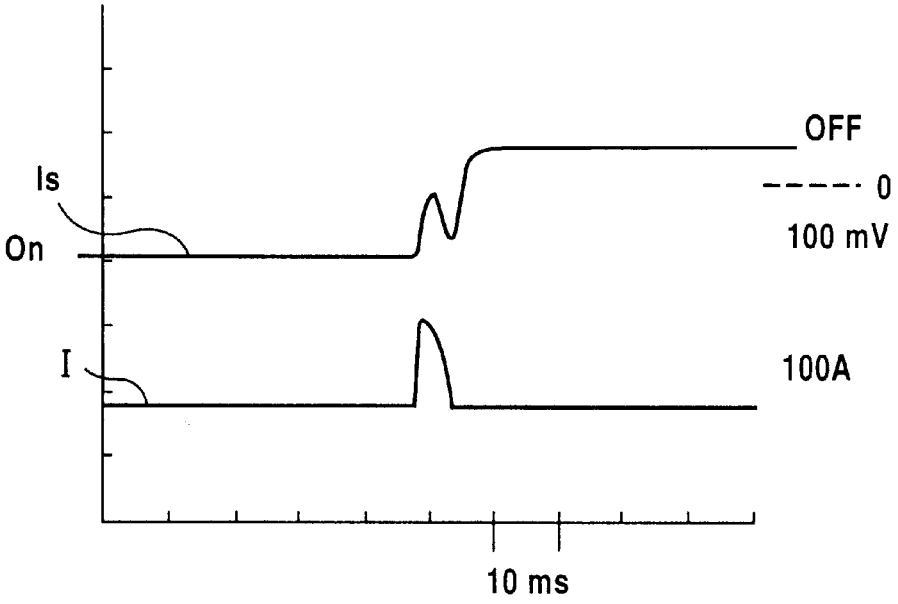
Figure 9:
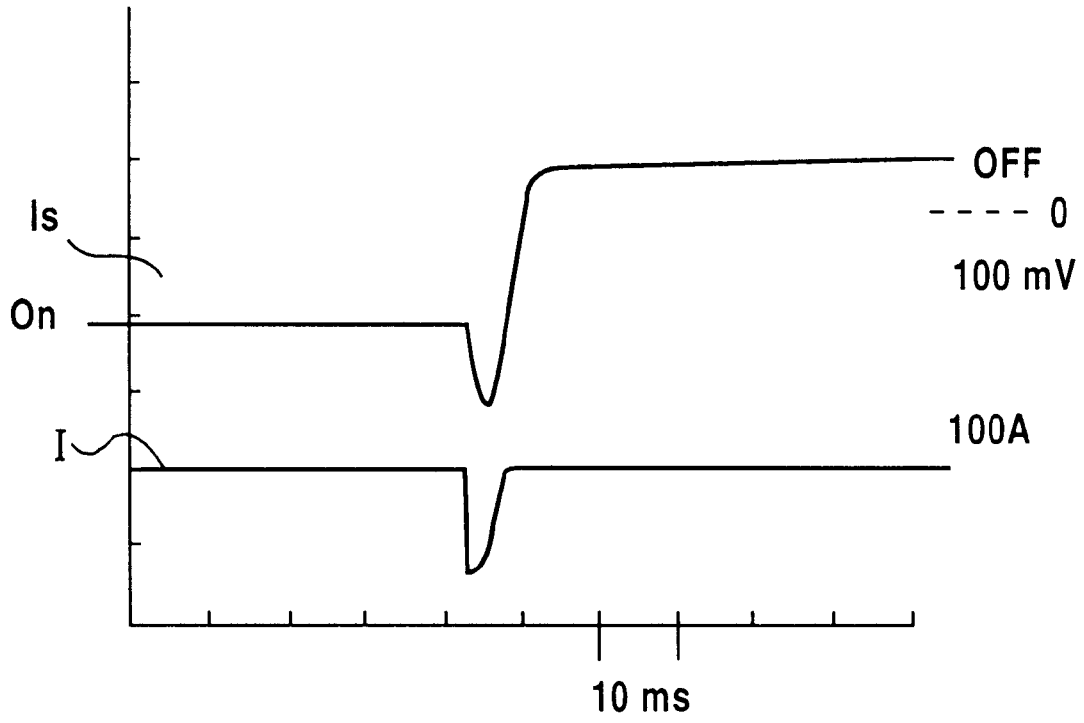

In the event of the short-circuit release of the circuit-breaker described with reference to FIG. 1 with approximately 100 A, the interference signal of the differential inductance sensor 60' reaches approximately half the signal swing between the switch-on and switch-off positions. In this case, the magnetic field influence stems principally from the release coil, which can be derived in detail from oscillograms in accordance with FIGS. 7 to 9.

Figure 10:
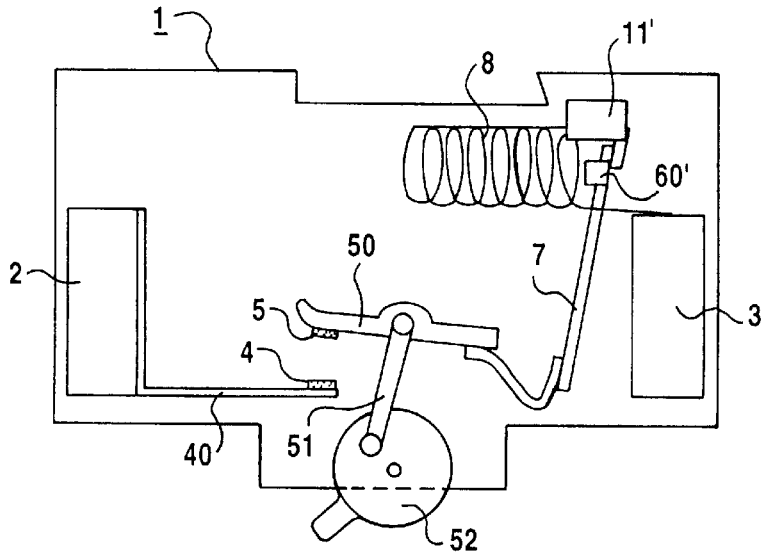
FIG. 10 is a view of a switching device similar to FIG. 1, in which an inductance sensor and an associated permanent magnet with a field-strengthening iron plate are fitted outside the switching device for the purpose of measuring current in a switching coil.
Figure 11:
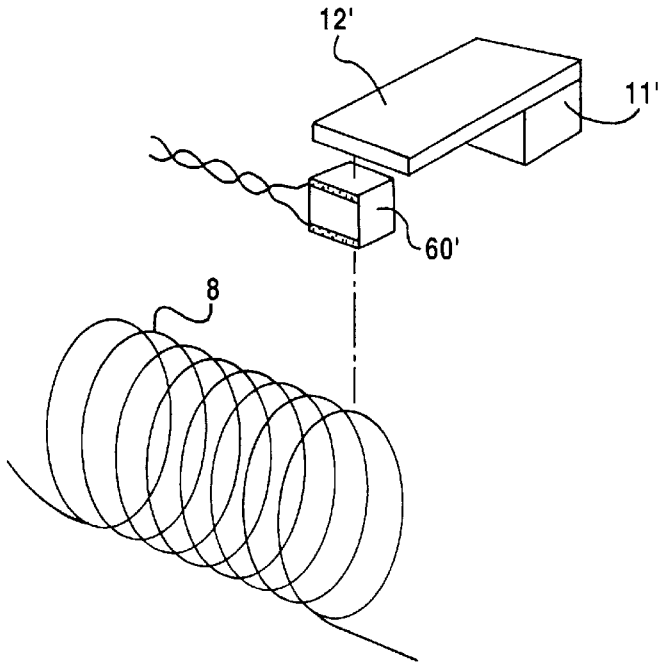
FIG. 11 is an exploded, perspective view for explaining FIG. 10.

The magnetic field sensitivity of magnetically biased inductance sensors, in particular, can also be utilized for coarse current measurement. For this purpose, the geometrical configuration of the switching device according to FIG. 1 is represented with reference to FIGS. 10 and 11. In the case of that configuration, an inductance sensor 60' is disposed in the vicinity of the solenoid 8 at a distance of 2 mm from the outside of the housing. The inductance sensor 60' is again associated with a permanent magnet 11' having a field-strengthening iron lamina 12'. It becomes clear, especially from FIG. 11, that coarse current measurement is possible with the inductance sensor 60' through the use of a determination of the magnetic field at the release coil, since the sensitivity of the sensor is increased by the magnetic biasing of the sensor.

Figure 12:
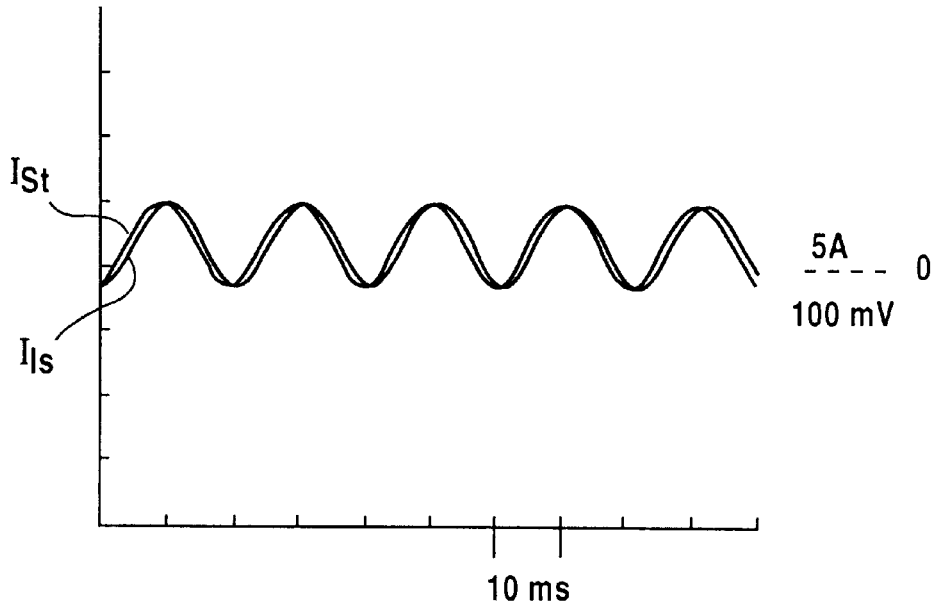
FIGS. 12 to 14 are graphs of oscillograms of a switching behavior in the case of the switching device according to FIG. 10.
Figure 13:
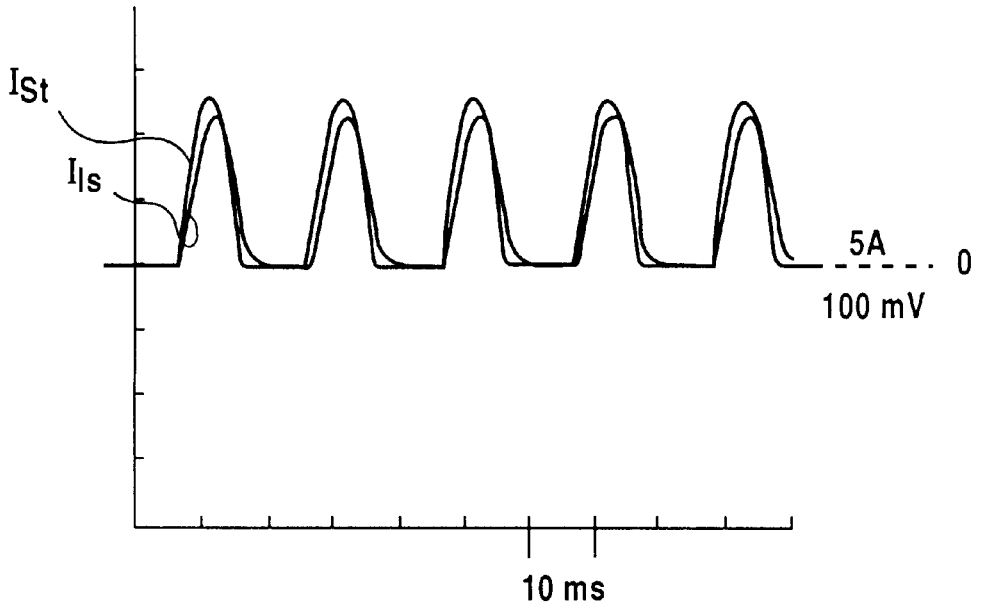
Figure 14:
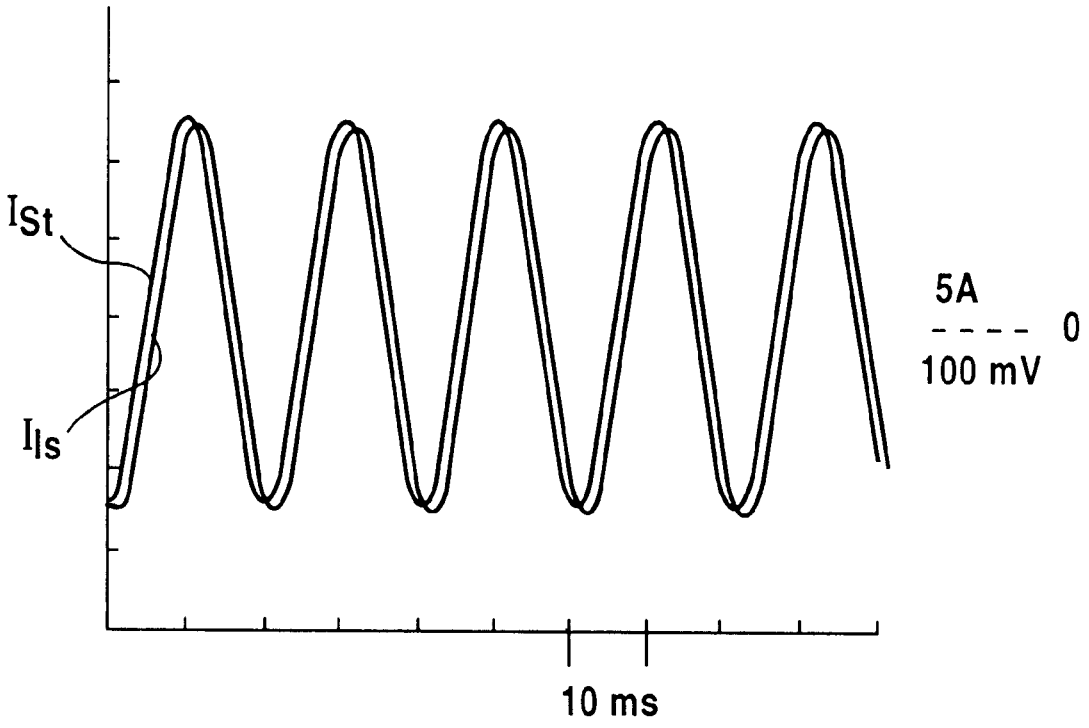

Various current characteristics were simulated with an electrical load at 220 V AC voltage with different power stages and are revealed in FIGS. 12 to 14 as measurement oscillograms. A relatively good proportionality of a sensor signal $I_{IS}$ to a precise current measurement signal $I_{St}$ of a current probe is obtained. A relative deviation of the measurement signal characteristics is less than 20% in this example. A prerequisite therefor is that the zero differential voltage is actually tuned to 0 V through the use of a stable generator frequency and generator amplitude.

A further possible application for the miniature inductance element specified herein is as a proximity or angle sensor in switching devices, if a permanent magnet is used as a pick-up element. This is explained with reference to FIG. 15.

Figure 15:
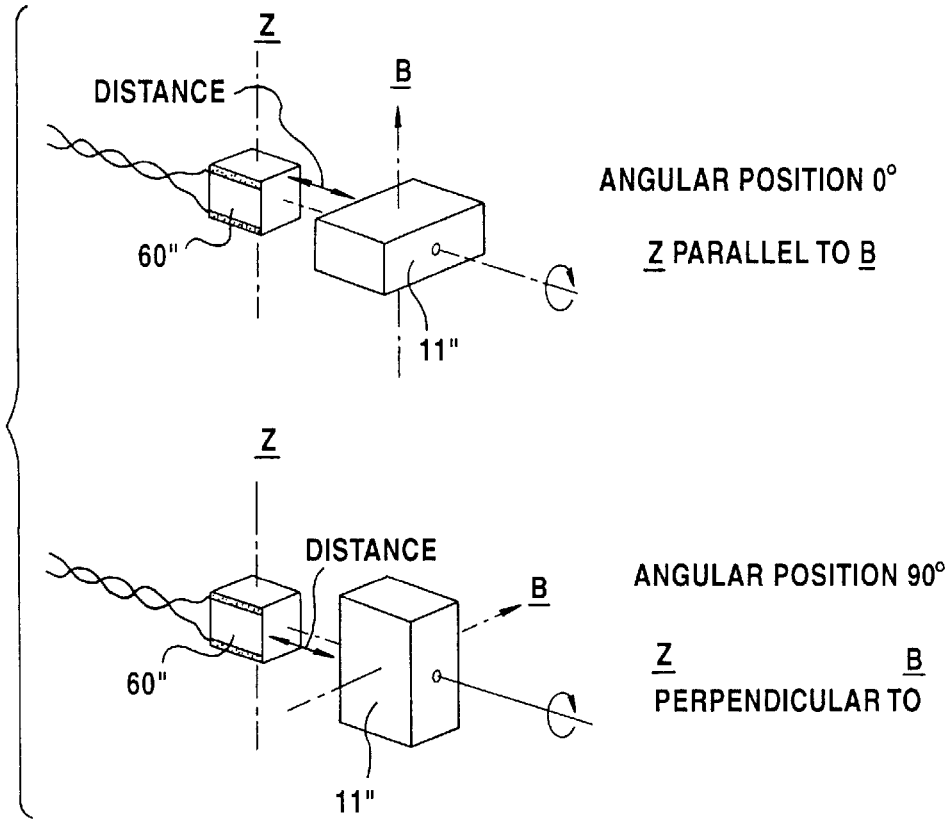
FIG. 15 is a perspective view showing a configuration of a miniature inductance element with a permanent magnet as an angle or a proximity sensor.

FIG. 15 shows, in detail, a geometrical association of an inductance sensor 60" to a rotatably mounted permanent magnet 11". An inductance signal of the sensor 60" can be processed further by the evaluation circuit of FIG. 3 and is illustrated as an oscillogram in FIG. 16.

Figure 16:
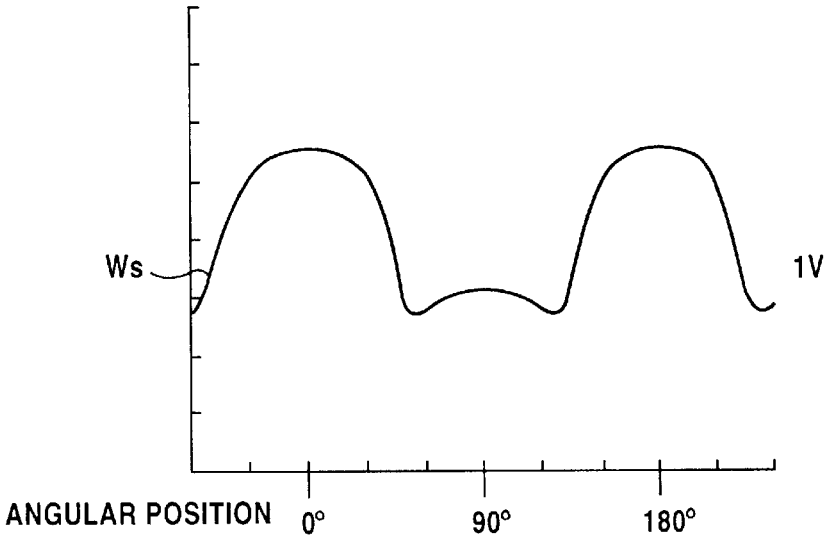
FIG. 16 is a graph of an oscillogram for explaining the action of FIG. 15.

FIG. 16 shows a voltage signal Ws, measured by an oscillograph, as a function of an angle of rotation. The sensor signal is dependent on a distance between the sensor 60" and the permanent magnet 11" and its period amounts to 180° of the angle of rotation. Therefore, the angle of rotation and the sensor signal are unambiguously associated with one another for a half-period of 90°.

The measurement signal characteristic in FIG. 16 is influenced by the tuning of the evaluation circuit and has approximately a sine squared characteristic. In this case, a sensitive measurement range extends over an angle of rotation range of approximately 25°. While the measurement signal differs greatly on the sine squared characteristic in the interval from 60 to 120° in accordance with FIG. 16, the sensor inductance exhibits a monotonically rising characteristic between $L_0$~185 $\mu$H and $L_{90}$~90 $\mu$H in the interval from 0 to 90° angle of rotation. Due to the strong magnetic field of the permanent magnet and the resultant large voltage swing in the measurement signal of 2 V, the susceptibility to interference from external magnetic fields is relatively low.

The angle sensor constructed with the miniature inductance element described herein can thus be used for identifying the switching state of a motor protective circuit-breaker, with the switch position and the short-circuit release being characterized by the angle of rotation position of the associated waves.

The evaluation circuits in FIGS. 3 and 5, in particular, show that the electronic outlay is low in the applications described herein for the miniature inductance elements and relates essentially to a square-wave generator with high frequency and amplitude stability in conjunction with low current loading and a differential amplifier for generating an output signal referring to 0 V. As a result, a switching device with positional monitoring is realized which requires only a small additional outlay.

I claim:

1. An electromechanical switching device, comprising:

a device housing having a switching handle part intended for manual release and another part coupled to said switching handle part, said parts having a position to be monitored;

at least one moveable contact and a drive associated with said at least one moveable contact in said device housing;

a device for contactlessly identifying a switching state, said device including at least one magnetic field sensor detecting magnetic field values each linked to one of a plurality of switching states;

said magnetic field sensor being a highly sensitive miniature inductance element having a ferrite core and forming an inductance sensor for at least one of monitoring the position of one of said parts and detecting a current flowing in the switching device; and said ferrite core of said miniature inductance element having a permeability altered by an action of external magnetic fields.

2. The switching device according to claim 1, wherein said at least one magnetic field sensor is disposed inside said device housing.

3. The switching device according to claim 1, wherein said at least one magnetic field sensor is disposed outside said device housing.

4. The switching device according to claim 1, wherein said at least one magnetic field sensor is disposed inside and outside said device housing.

5. The switching device according to claim 1, wherein said miniature inductance element has pronounced axial geometries, and said sensor has a distinct sensitivity with respect to a field direction.

6. The switching device according to claim 1, including an evaluation circuit evaluating an inductance of said miniature inductance element with an oscillator circuit.

7. The switching device according to claim 1, wherein said other part is a ferromagnetic drive clip for said switching handle part, and said inductance sensor together with an associated permanent magnet and an additional iron plate for field strengthening are disposed next to said ferromagnetic drive clip for detecting an on/off state of said switching handle part.

8. The switching device according to claim 6, including a square-wave generator for feeding said evaluation circuit, and a differential amplifier for further processing an output signal.

9. The switching device according to claim 8, including another inductance sensor, said two inductance sensors forming a differential circuit.

10. The switching device according to claim 1, including a solenoid acting as a release coil, said miniature inductance element having a magnetic field sensitivity utilized for measuring current in said release coil.

11. The switching device according to claim 10, including a permanent magnet acting as a pick-up element connected to said part to be monitored, said miniature inductance elements used as at least one of proximity and angle sensors.

* * * * *